US011661151B2

(12) United States Patent
Sævik et al.

(10) Patent No.: US 11,661,151 B2
(45) Date of Patent: May 30, 2023

(54) MOORING TENSIONING ARRANGEMENT AND A METHOD FOR LONGITUDINAL CROSS TENSION OF A MOORING SYSTEM

(71) Applicant: Kongsberg Maritime AS, Horten (NO)

(72) Inventors: Tor Sævik, Ålesund (NO); Johnny Lorgen, Brattvåg (NO); André Larsen, Ålesund (NO); Martijn De Jongh, Ulsteinvik (NO)

(73) Assignee: KONGSBERG MARITIME CM AS, Horten (NO)

( * ) Notice: Subject to any disclaimer, the term of this patent is extended or adjusted under 35 U.S.C. 154(b) by 242 days.

(21) Appl. No.: 17/270,965

(22) PCT Filed: Aug. 23, 2019

(86) PCT No.: PCT/NO2019/050172

§ 371 (c)(1),
(2) Date: Feb. 24, 2021

(87) PCT Pub. No.: WO2020/040646

PCT Pub. Date: Feb. 27, 2020

(65) Prior Publication Data

US 2021/0245841 A1 Aug. 12, 2021

(30) Foreign Application Priority Data

Aug. 24, 2018 (NO) ..... 20181111

(51) Int. Cl.
*B63B 21/16* (2006.01)
*B63B 21/18* (2006.01)
*B63B 21/22* (2006.01)

(52) U.S. Cl.
CPC ..... *B63B 21/16* (2013.01); *B63B 21/18* (2013.01); *B63B 21/22* (2013.01)

(58) Field of Classification Search
CPC ..... B63B 21/16; B63B 21/18; B63B 21/22; B63B 21/50; B63B 21/00
See application file for complete search history.

(56) References Cited

U.S. PATENT DOCUMENTS 3,552,343 A 1/1971 Scott
2010/0098498 A1 4/2010 Humphreys

FOREIGN PATENT DOCUMENTS

JP H07187057 A 7/1995
JP 2018039475 A 3/2018
(Continued)

OTHER PUBLICATIONS

Patent Cooperation Treaty, International Search Report, PCT/NO2019/050172, dated Nov. 19, 2019, Applicant: Kongsberg Maritime CM AS.

(Continued)

*Primary Examiner* — Anthony D Wiest
(74) *Attorney, Agent, or Firm* — Flener IP & Business Law; Zareefa B. Flener

(57) ABSTRACT

Mooring tensioning arrangement (10) on a vessel (60), comprising a moonpool (20) having a through miming vertical channel with an upper moonpool opening (22) in proximity to a deck (62) of the vessel (60), and a bottom moonpool opening (24) open to surrounding sea (30). A winch (14) is located above the moonpool (20), wherein a first anchor wire pennant (42) runs from the winch (14), over a stern (64) of the vessel (60) and into sea (30), and a second anchor wire pennant (46) runs from the winch (14), through the moonpool (20) and into the sea (30). A wire/chain stopper (18) securing the second anchor wire pennant (46) is placed in the moonpool (20), and the bottom moonpool (Continued)

opening (24) is curved to match bending 0radius and to provide a transition in direction of the second anchor wire pennant (46).

5 Claims, 5 Drawing Sheets

(56) References Cited

FOREIGN PATENT DOCUMENTS

| | | | |
|---|---|---|---|
| NL | 2004529 | C2 | 10/2011 |
| WO | 9626862 | A1 | 9/1996 |

OTHER PUBLICATIONS

Norwegian Industrial Property Office, Norwegian Search Report, NO20181111, dated Mar. 22, 2019, Applicant: Kongsberg Maritime CM AS.

MOORING TENSIONING ARRANGEMENT AND A METHOD FOR LONGITUDINAL CROSS TENSION OF A MOORING SYSTEM

FIELD OF THE INVENTION

The present invention relates to a mooring tensioning arrangement and a method for pre-tensioning and bedding in the anchors of the mooring system be means of longitudinal cross tension, using said mooring tensioning arrangement.

BACKGROUND OF THE INVENTION

As part of the installation of an offshore mooring systems, the tensioning of mooring systems is typically done by high BP vessel and possibly tandem operation with two vessels or by means of transverse cross-tensioning.

High BP vessels can be expensive vessels, while inline tandem operation has the danger of one single vessel with full tension and transverse cross tension danger for high sideways loads.

All these methods either have a high cost, or have safety risks.

DISCLOSURE OF THE STATE OF ART

US 2010/098498 A1 disclose an anchor system that may reduce stress on anchor cables when an offshore drilling platform weathervanes. The anchor system may hold the platform in a set position above the sea floor during drilling operations. The anchor system includes anchor cables that pass through a split bearing. Clamps may be connected to the bearing to hold the anchor cables in tension.

JPH 07187057 A disclose that a chain locker with an anchor chain housing section and an anchor housing cylinder connected thereto are arranged near the ship's bottom plate of a hull, and the forward end of the cylinder is connected to the bellmouth of an anchoring port formed on the bottom plate, thereby installing anchoring equipment on board.

U.S. Pat. No. 3,552,343 A disclose an anchoring system for a drilling vessel floating on a body of water. A plurality of anchor cables extend from moonpool anchor winches mounted on the deck of the drilling vessel which surrounds the moonpool. These anchor lines go downwardly along the wall of the moonpool and then outwardly to anchors spaced from the ship. There are two bow anchor winches mounted on the bow of the ship. When the ship is in its normal or neutral position, the anchor lines from these extend outwardly perpendicular to the longitudinal axis of the drilling vessel. By taking up on one of the bow anchor lines and letting out on the other, the ship can be made to rotate about its moonpool for approximately a total of 150°. At the same time, the moonpool anchor lines are let in or payed out, from the moonpool anchor winches, as necessary to retain the desired tension on each such anchor line.

OBJECTS OF THE PRESENT INVENTION

It is an object to provide an arrangement and a method that makes it possible to arrange the vessel for longitudinal cross tension of the mooring system before the object to be moored is connected. It may thus be possible to perform anchor bedding and mooring system tensioning with lower BP vessels, and perform the cross tension without the risk for high sideways loads and heeling moments.

Advantages with the present invention is that the mooring system elements are only loaded in their intended way. Upon breakage or loss of one of the mooring lines, the vessel is either pull straight ahead or astern, which gives no sideways force/heeling moment. Downward force will always be on or near the centerline of the vessel, which also gives no large heeling moments.

The invention uses winch pull rather than BP/engine power to create tension, which is more environmental friendly. It might be possible that it also gives less power required for heading control, and possibly less trimming moment.

Using the mooring tensioning arrangement and method according to the invention may also potentially give faster operation compared to single system tensioning.

It is further an object to provide a mooring tensioning arrangement for longitudinal cross tension of the mooring system, in where one of the mooring lines can be secured in the moonpool. An object is also to provide a bottom moonpool opening that is curved to match bending radius and to provide a smooth transition in direction of the mooring or pennant line.

The arrangement does not require the secured mooring line through the moonpool to be pulled under the tensioning phase. The tensioning is achieved by pulling in the second line, which runs over the vessel stern.

SUMMARY OF THE INVENTION

The above objects are achieved with a mooring tensioning arrangement comprising a moonpool having a through running vertical channel with an upper moonpool opening in proximity to a deck of the vessel, and a bottom moonpool opening open to surrounding sea. The mooring arrangement further comprises a winch located above the moonpool, wherein a first anchor wire pennant runs from the winch, over a stern of the vessel and into the sea, and a second anchor wire pennant runs from the winch, through the moonpool and into the sea. A wire/chain stopper securing the anchor wire pennant is placed in the moonpool, and the bottom moonpool opening is curved to match bending radius and to provide a transition in direction of the second anchor wire pennant.

The bottom moonpool opening can be a moonpool bell end curved to match bending radius and to provide the transition in direction of the second mooring or pennant line.

The wire/chain stopper may enable inline load transfer into the vessel.

The mooring tensioning arrangement may further comprise a turning block placed above the moonpool, said turning block being a roller/sheave arrangement guiding the second anchor wire pennant to the winch.

The anchor wire pennants are mooring lines such as a pennant, wire, rope, chain, anchor wire, anchor wire pennant, or similar, for mooring purposes.

The first anchor wire pennant running over the vessel stern and the second anchor wire pennant running through the moonpool can be wound on a mutual winch drum.

Alternatively, the second anchor wire pennant running through the moonpool can be wound on a second winch drum, and the first anchor wire pennant running over the vessel stern can be wound on a first winch drum.

The upper moonpool opening can be equipped with a hatch to close the deck of the vessel.

The above objects are also achieved with a method for longitudinal cross tension of a mooring system, in where a vessel comprises a mooring tensioning arrangement with a moonpool having an through running vertical channel with an upper moonpool opening in proximity to a deck of the vessel, and a bottom moonpool opening open to surrounding sea, a winch located above the moonpool, wherein a first anchor wire pennant runs from the winch, over a stern of the vessel and into the sea, and a second anchor wire pennant runs from the winch, through the moonpool and into the sea, and a wire/chain stopper securing lines in the moonpool, wherein the mooring arrangement is centrally placed and in or close to a centerline of the vessel, said method comprises the steps:

- connecting the vessel to a first anchor wire using the first anchor wire pennant, said first anchor wire pennant runs from aft of the vessel to the first anchor wire,
- sailing the vessel to a second anchor wire, while paying out the first anchor wire pennant,
- lowering a pick-up line through the moonpool of the vessel to connect to the second anchor wire, and pulling the second anchor wire through the moonpool onto the deck of the vessel,
- connecting the second anchor wire to the second anchor wire pennant,
- lowering the second anchor wire and the second anchor wire pennant through the moonpool,
- paying out the second anchor wire pennant to a predetermined length,
- securing the second anchor wire pennant in the wire/chain stopper in the moonpool, and
- pulling the vessel to a central location by hauling in the first anchor wire pennant.

The sequence between the first and second anchor can also be done in contrary order.

According to the method, the vessel can be pulled in to the central location until desired tension in the anchor wires and/or anchor wire pennants are reached. Auxiliary anchor lines can optionally be connected to the vessel in a conventional manner.

The pick-up line lowered through the moonpool can be connected to the second anchor wire using a ROV.

Alternatively, the pick-up line lowered through the moonpool can be connected to the second anchor wire using a guide rope through the moonpool.

DESCRIPTION OF THE DRAWINGS

Embodiments of the present invention will now be described, by way of example only, with reference to the following drawings, wherein.

DESCRIPTION OF PREFERRED EMBODIMENTS OF THE INVENTION

Figure 1:
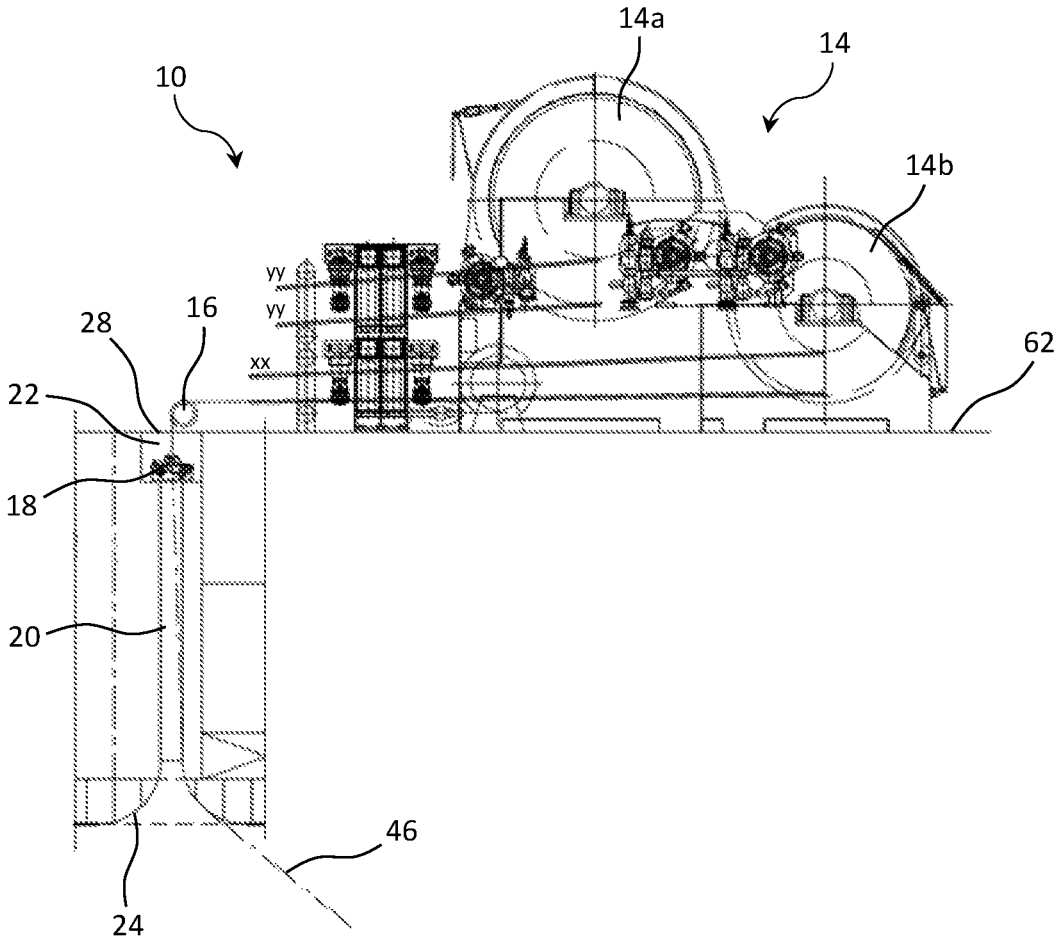
FIG. 1 shows a mooring arrangement according to the invention.

FIG. 1 shows a mooring tensioning arrangement according to the invention. The mooring tensioning arrangement 10 is placed on a vessel 60, however preferably partly integrated and partly placed on a deck 62 of the vessel 60.

The mooring tensioning arrangement 10 comprises a winch 14 placed on the deck 62 of the vessel 60. A moonpool 20 runs in vertical direction through the hull of the vessel 60, i.e. the moonpool 20 has a through running vertical channel with an upper moonpool opening 22 in proximity to the deck 62 of the vessel 60, and a bottom moonpool bell end 24 open to surrounding sea 30. The bottom bell end 24 of the moonpool 20 can shaped and curved to match bending radius of pennant and mooring system elements.

A first mooring line, such as an anchor wire pennant 42, runs from the winch 14, over a stern 64 of the vessel 60 and into the sea, and a second mooring line, such as an anchor wire pennant 46, runs from the winch 14, through the moonpool 20 and into the sea 30. The winch 14 is equipped with several winch drums, i.e. a first winch drum 14*a* and a second winch drum 14*b*. The first anchor wire pennant 42 running over the vessel stern 64 and the second anchor wire pennant 46 running through the moonpool 20 can be wound on a mutual winch drum, 14*a* or 14*b*. Alternatively, the second anchor wire pennant 46 running through the moonpool 20 can be wound on the second winch drum 14*b*, and the first anchor wire pennant 42 running over the vessel stern 64 can be wound on the first winch drum 14*a*. The references "xx" and "yy" indicates any of the mooring lines, or pick-up line, in case a different configuration is chosen regarding which drum to use.

The mooring lines can be a pennant, wire, rope, chain, anchor wire, anchor wire pennant, or similar, for mooring purposes.

The moonpool 20 also comprises a wire/chain stopper 18 for securing the second anchor wire pennant 46 in the moonpool 20. The wire/chain stopper 18 is preferably arranged to enable inline load transfer into the vessel 60, and makes it possible to avoid additional 90 degrees bend under full tension.

Further, a turning block 16 is placed above the moonpool 20. The turning block 16 can be a roller/sheave arrangement guiding the second anchor wire pennant 46 to the winch 14, in order to lower or haul in the mooring system.

The upper moonpool opening 22 may further be equipped with a hatch 28 to close the deck 62 of the vessel 60, thereby creating an undisturbed cargo deck.

Figure 2:
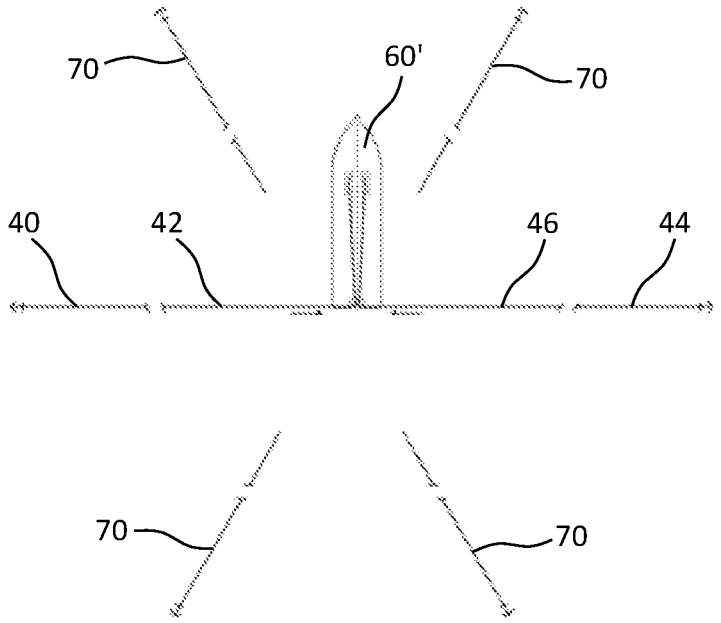
FIG. 2 shows a set up for a typical transverse cross tensioning mooring.

FIG. 2 shows a typical transverse cross tensioning set up, in where a vessel 60' is at aft connected to two mooring lines, i.e. the first mooring lines 40, 42 on port side and the second mooring lines 46, 44 on starboard side. The vessel 60' is thus perpendicular to the mooring system. Additional mooring lines 70 can be used.

Figure 3:
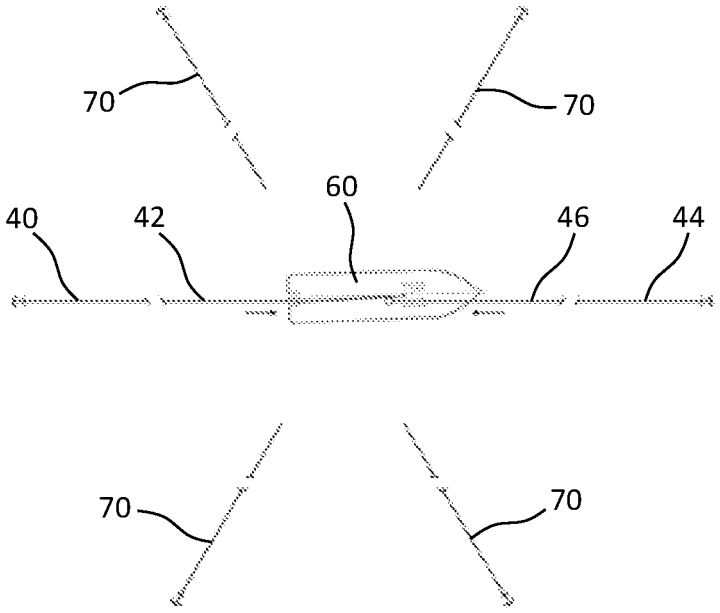
FIG. 3 shows a set up for a longitudinal cross tensioning mooring according to the invention.

FIG. 3 shows a longitudinal cross tensioning mooring set up according to the invention. As shown, first mooring lines 40, 42 are (near) longitudinal with the vessel 60 and connected to the aft of the vessel. The second mooring lines 46, 44 are also (near) longitudinal with the vessel 60 and connected through the moonpool 20 to the vessel 60. Additional mooring lines 70 can also be used in this case.

The method for performing the longitudinal cross tensioning mooring according to the invention shall now be described in relation to FIGS. 4-11.

Figure 4:
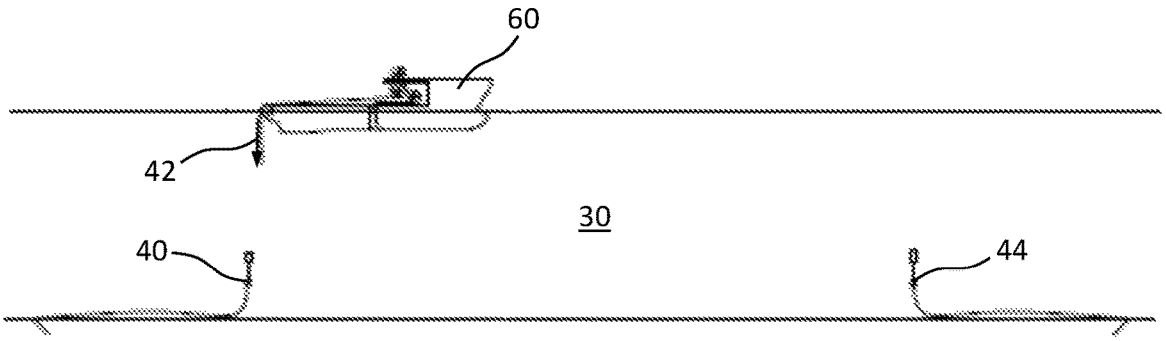
FIGS. 4-11 show a procedure for performing the longitudinal cross tensioning of a mooring system according to the invention.
Figure 5:
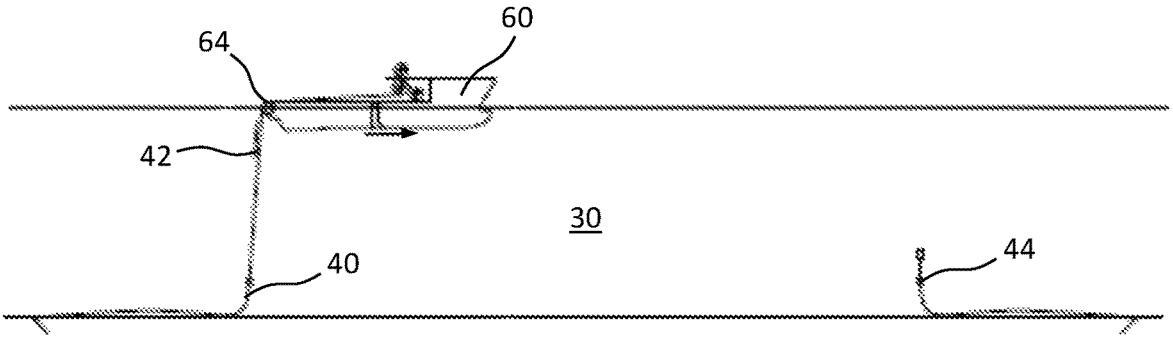
Figure 6:
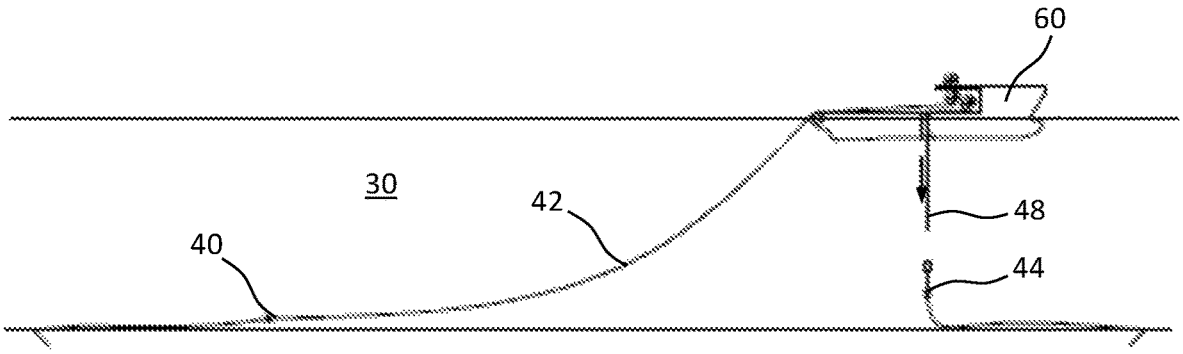

Starting from FIG. 4, the vessel 60 is connecting to a first anchor wire 40 in a conventional way using a first anchor wire pennant 42 (first mooring line) running from aft of the vessel 60. The vessel 60 in FIG. 5 is sailing towards a second anchor wire 44, paying out the first anchor wire pennant 42. In FIG. 6, a pick up wire or line 48 is lowered through the moonpool 20 to connect to the second anchor wire 44.

Figure 7:
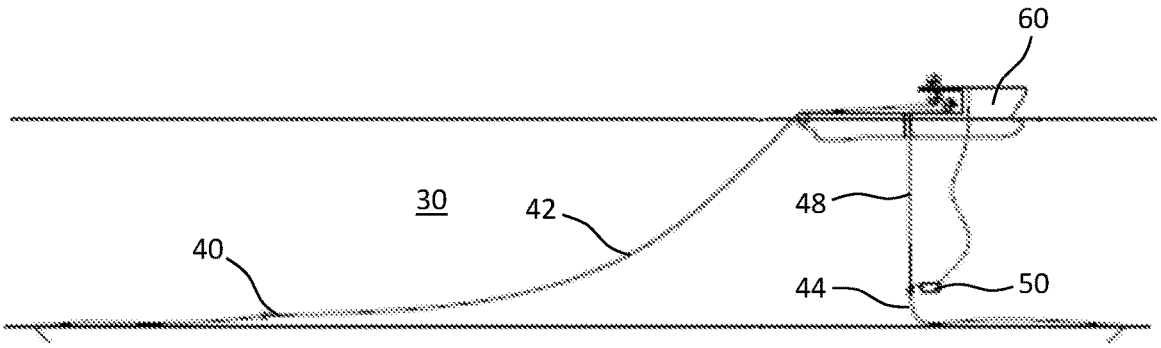

Connection to the second anchor wire 44 can be established by means of a ROV 50, as shown in FIG. 7, or otherwise.

Figure 8:
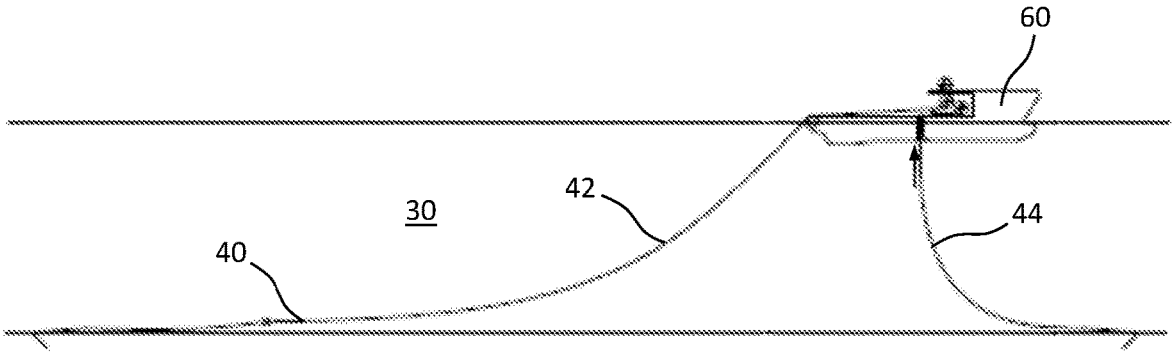
Figure 9:
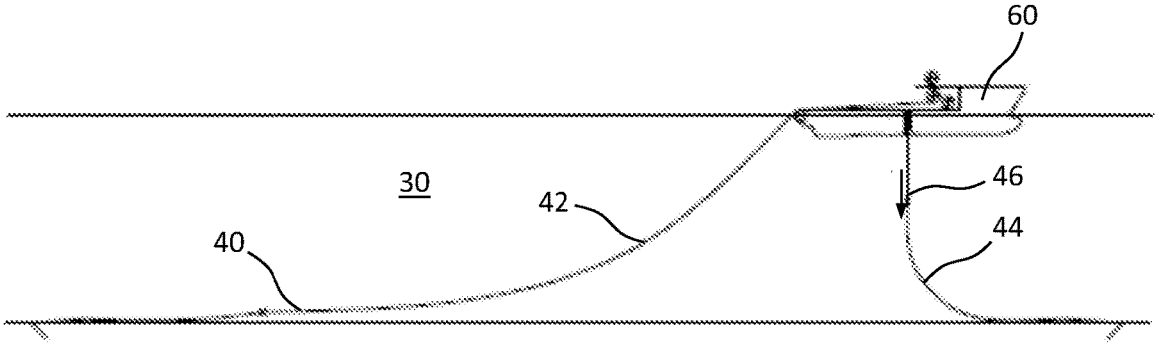

The second anchor wire 44 is pulled onto deck 62 and can be secured in the wire/chain stopper 18, as shown in FIG. 8. At least the connection shackle is pulled on deck to connect the vessel's pennant wire, i.e. the second anchor wire pennant 46 (second mooring line). The second anchor wire pennant 46 is preferably a chain. Thereafter, as shown in FIG. 9, the second anchor wire 44 is lowered and the vessel's moonpool pennant, i.e. the second anchor wire pennant 46, is paid out to a predetermined length and secured in the wire/chain stopper 18. The second anchor wire pennant 46 can then be disconnected from the winch 14.

Figure 10:
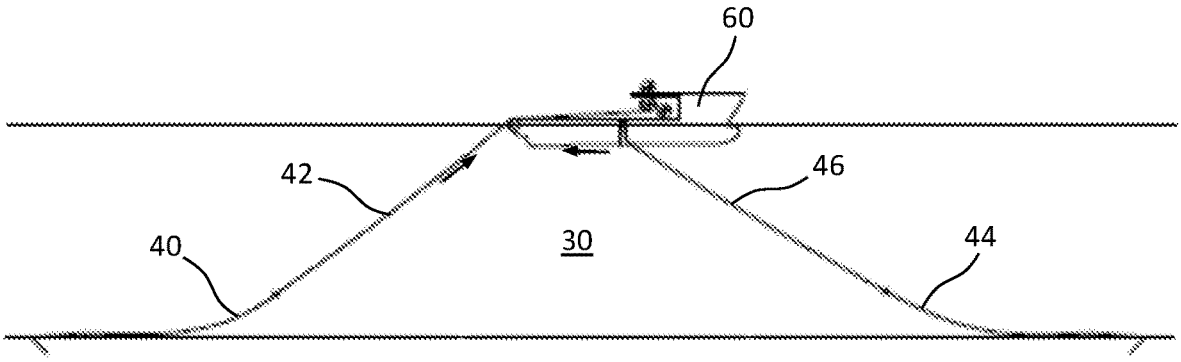

As shown in FIG. 10, the vessel 60 is thereafter pulled to a desired center location by hauling in the first anchor wire pennant 42 and pulled in until test or desired tension is reached.

Figure 11:
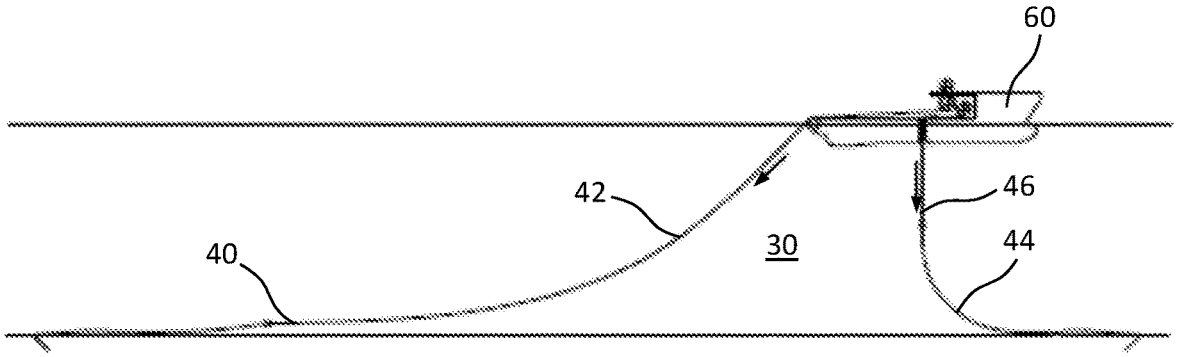

FIG. 11 shows that after bedding, the tension is released from the first anchor wire 40 and the vessel is sailed to the second anchor wire 44 location where this one is released as well. Hence, the procedure is reversed and both systems are released.

The invention claimed is:

1. A method for longitudinal cross tension of a mooring system, wherein a vessel comprises:

a mooring tensioning arrangement with a moonpool having a through running vertical channel with an upper moonpool opening in proximity to a deck of the vessel, a bottom moonpool opening open to surrounding sea, a winch located above the moonpool, wherein a first anchor wire pennant runs from the winch, over a stern of the vessel and into the sea, and a second anchor wire pennant runs from the winch, through the moonpool and into the sea, and a wire/chain stopper securing lines in the moonpool, wherein the mooring arrangement is centrally placed and in or close to a centerline of the vessel, and wherein said method comprises the steps:

connecting the vessel to a first anchor wire using the first anchor wire pennant, said first anchor wire pennant runs from aft of the vessel to the first anchor wire, sailing the vessel to a second anchor wire, while paying out the first anchor wire pennant, lowering a pick-up line through the moonpool of the vessel for connection to the second anchor wire, and pulling the second anchor wire through the moonpool onto the deck of the vessel, connecting the second anchor wire to a second anchor wire pennant, lowering the second anchor wire and the second anchor wire pennant through the moonpool, paying out the second anchor wire pennant to a predetermined length, securing the second anchor wire pennant in the wire/chain stopper in the moonpool, and pulling the vessel to a central location by hauling in the first anchor wire pennant.

2. The method according to claim 1, wherein said method further comprises the step of pulling the vessel in to the central location until desired tension in the anchor wires and/or anchor wire pennants is reached.

3. The method according to claim 1, wherein said method further comprises the step of optionally connecting auxiliary anchor lines to the vessel in a conventional manner.

4. The method according to claim 1, wherein said method further comprises the step of connecting the pick-up line lowered through the moonpool to the second anchor wire using a ROV.

5. The method according to claim 1, wherein said method further comprises the step of connecting the pick-up line lowered through the moonpool to the second anchor wire using a guide rope through the moonpool.

* * * * *